US012760505B2

(12) United States Patent
Lim

(10) Patent No.: US 12,760,505 B2
(45) Date of Patent: Oct. 13, 2026

(54) DRAIN CLEANING DEVICE

(71) Applicant: MILWAUKEE ELECTRIC TOOL CORPORATION, Brookfield, WI (US)

(72) Inventor: Ka Seng Lim, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 319 days.

(21) Appl. No.: 18/390,509

(22) Filed: Dec. 20, 2023

(65) Prior Publication Data

US 2024/0209608 A1 Jun. 27, 2024

Related U.S. Application Data

(60) Provisional application No. 63/476,731, filed on Dec. 22, 2022.

(51) Int. Cl.
*E03C 1/302* (2006.01)

(52) U.S. Cl.
CPC ..... *E03C 1/302* (2013.01)

(58) Field of Classification Search
CPC ..... E03C 1/302; E03F 9/005
See application file for complete search history.

(56) References Cited

U.S. PATENT DOCUMENTS 2,267,493 A 12/1941 Clotz
3,071,794 A 1/1963 Prange
3,077,314 A 2/1963 Caperton
3,222,704 A 12/1965 Ciaccio
3,983,593 A 10/1976 Naeve
4,914,775 A * 4/1990 Kirk ..... E03F 9/005 242/387
5,222,270 A 6/1993 Sloter et al.
7,367,077 B2 * 5/2008 Rutkowski ..... B08B 9/045 15/104.31

FOREIGN PATENT DOCUMENTS

CN 211247647 U 8/2020
CN 212168420 U 12/2020
EP 2578129 A2 4/2013

* cited by examiner

*Primary Examiner* — Sabbir Hasan
(74) *Attorney, Agent, or Firm* — Michael Best & Friedrich LLP

(57) ABSTRACT

A drain cleaning device including a frame and a drum assembly supported by the frame. The drum assembly includes an inner drum, an outer drum, and a space defined therebetween. The drum assembly configured to rotate about an axis of rotation. The drain cleaning device also includes a motor supported by the drum assembly. The motor includes an output shaft. The drain cleaning machine further includes a flexible cable stored within the space. The flexible cable defines a first end and a second end opposite the first end. The first end is coupled to the output shaft to receive torque from the motor. The drain cleaning device further includes a cable stop assembly positioned over at least a portion of the space to at least partially cover the space.

16 Claims, 8 Drawing Sheets

DRAIN CLEANING DEVICE

CROSS-REFERENCE TO RELATED APPLICATIONS

This application claims priority to U.S. Provisional Patent Application No. 63/476,731, filed Dec. 22, 2022, the entire contents of which are incorporated herein by reference.

BACKGROUND OF THE INVENTION

The present application relates to drain cleaning devices for cleaning drains, pipes, or other conduits, and specifically, to a flexible shaft drain cleaner.

Flexible shaft drain cleaners are known as high speed drain cleaners because they include motors that spin the cable at higher speeds. The higher speed is produced by directly driving the cable with torque from a motor/drive mechanism. In addition, flexible shaft drain cleaners include an improved cable to withstand the higher speeds. Flexible shaft cables typically include a wound cable that is encased by a sheath.

SUMMARY

In one independent aspect, the invention provides a drain cleaning device including a frame and a drum assembly supported by the frame. The drum assembly includes an inner drum, an outer drum, and a space defined therebetween. The drum assembly configured to rotate about an axis of rotation. The drain cleaning device also includes a motor supported by the drum assembly. The motor includes an output shaft. The drain cleaning machine further includes a flexible cable stored within the space. The flexible cable defines a first end and a second end opposite the first end. The first end is coupled to the output shaft to receive torque from the motor. The drain cleaning device further includes a cable stop assembly positioned over at least a portion of the space to at least partially cover the space.

In another aspect, the invention provides a drain cleaning device including a drum assembly defining a closed rear end and an open front end opposite the rear end. The drum assembly includes an inner drum, an outer drum, and a space defined therebetween. The drum assembly is configured to rotate about an axis of rotation. The drain cleaning device also includes a flexible cable stored within the space. The flexible cable defines a first end and a second end opposite the first end. The drain cleaning device further includes a cable stop assembly positioned over at least a portion of the space to inhibit the cable from unintentionally exiting the space. The cable stop assembly disposed adjacent the open front end of the drum assembly.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
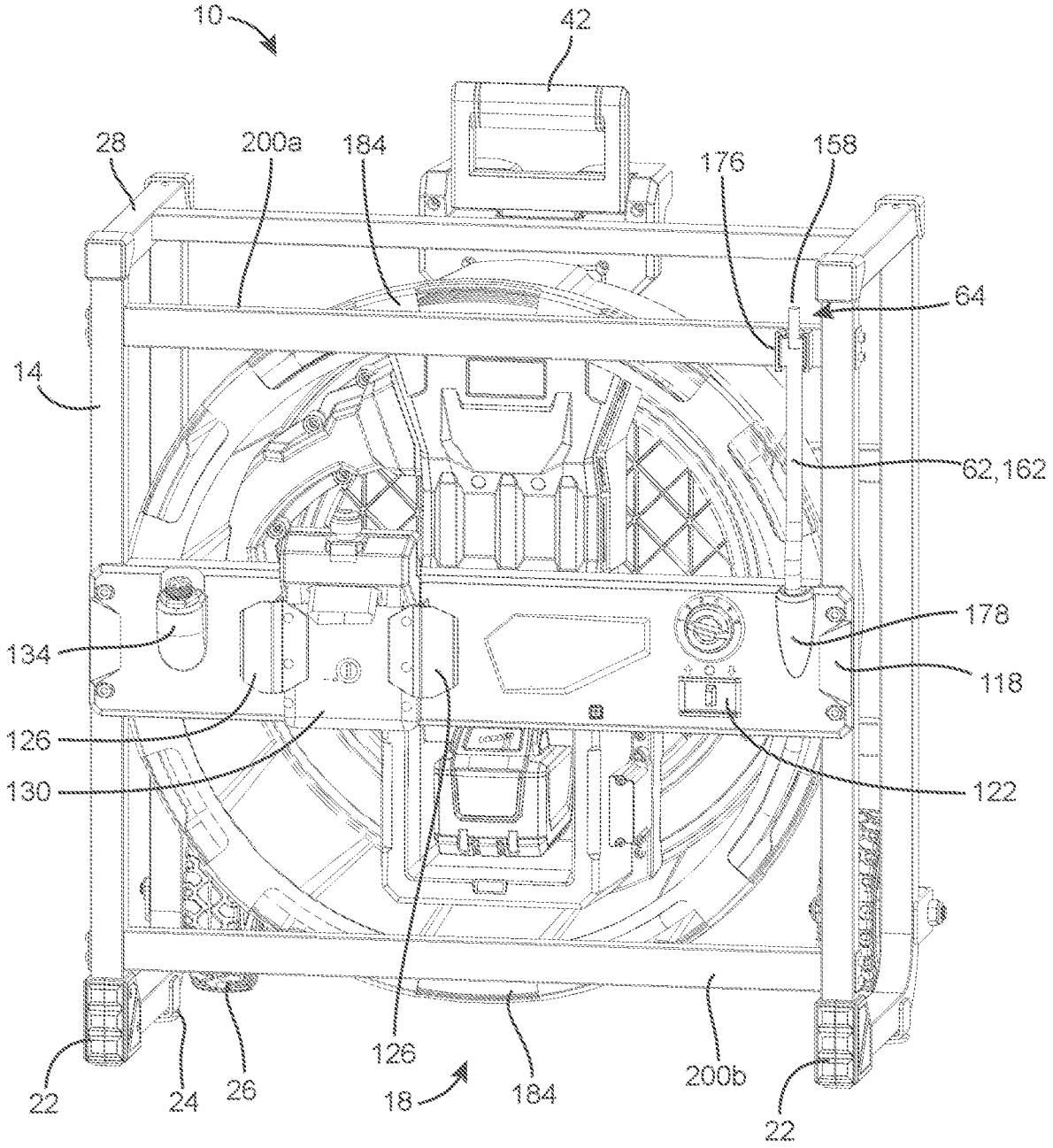
FIG. 1 is a front perspective view of a drain cleaning device.
Figure 2:
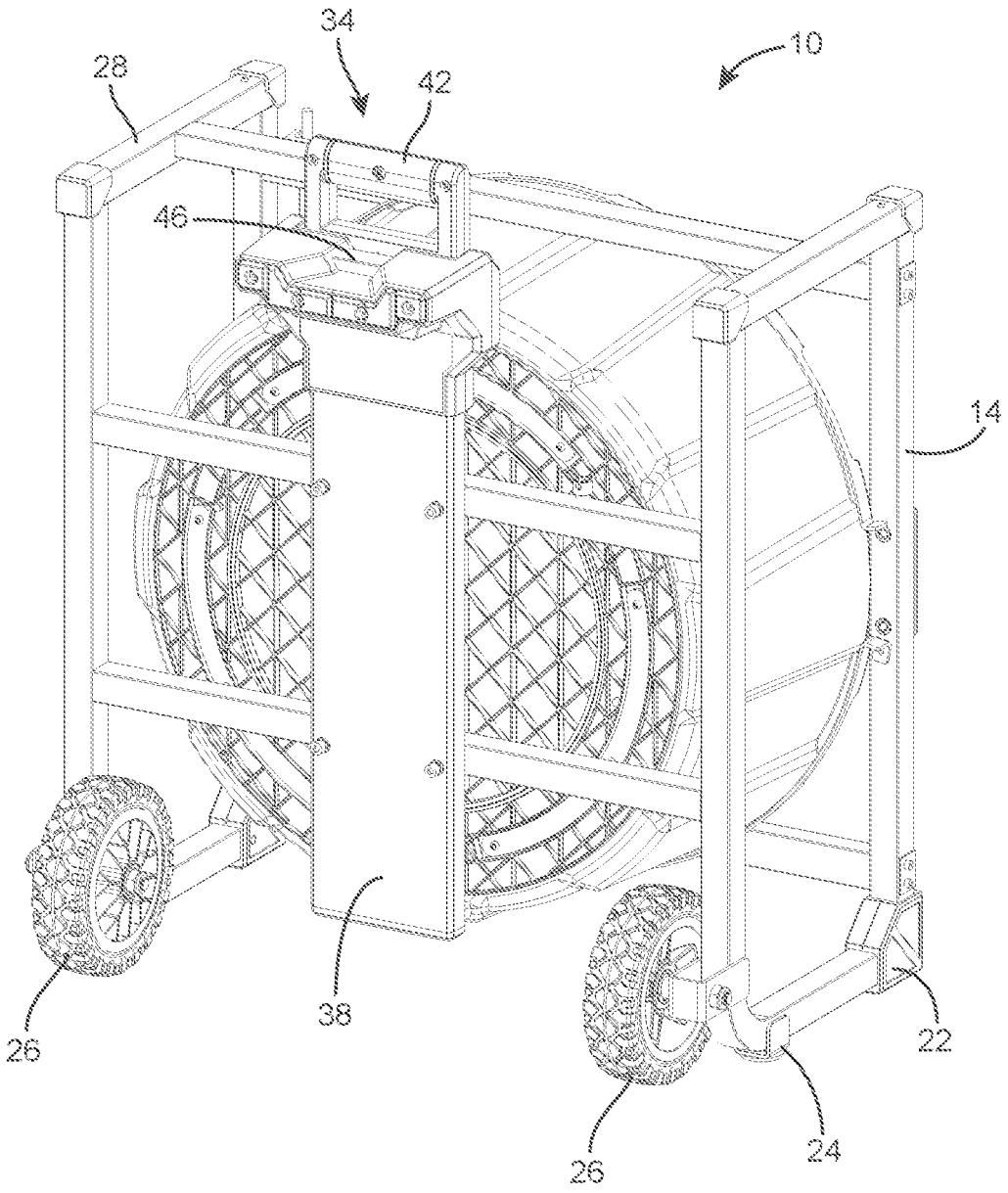
FIG. 2 is a rear perspective view of the drain cleaning device of FIG. 1.

FIGS. 1 and 2 illustrate a drain cleaning device 10 that is operable to clear and clean debris from pipes or other conduits. In the illustrated embodiment, the drain cleaning device 10 is a flexible shaft drain cleaner. The drain cleaning device 10 is operable to spin a drain cleaning cable at a relatively high speed. As described below, the drain cleaning cable may include a wound cable, or other suitable cable, positioned within a sheath. The wound cable is driven (e.g., spun) by the drain cleaning device 10 within the sheath to clear debris from a conduit.

The illustrated drain cleaning device 10 includes a frame 14 and a drum assembly 18 supported by the frame 14. The frame 14 is made from a plurality of bars or links that are coupled together through welding, fasteners, or the like. The bars of the frame 14 are coupled together to form a cage-like structure around the drum assembly 18. In some embodiments, the frame 14 is made from a metal material such as aluminum or steel. In other embodiments, the frame 14 may be made from other materials such as plastic or the like. The frame 14 includes a pair of rubber grommets 22 on a front side to help stabilize the drain cleaning device 10 when the drain cleaning device 10 is in an upright position, as shown in FIG. 1. The frame 14 also includes feet 24 to help further stabilize the drain cleaning device 10 in the upright position. Wheels 26 are coupled to a back side of the frame 14 to facilitate transporting the drain cleaning device 10 across a surface. For example, the drain cleaning device 10 may be tipped onto the wheels 26 (and off of the grommets 22 and feet 24) to move the drain cleaning device 10 along the ground. The illustrated wheels 26 are positioned adjacent, but rearward of the feet 24. In the illustrated embodiment, the wheels 26 are idle (i.e., non-driven wheels). In other embodiments, the wheels 26 may be driven wheels. The drain cleaning device 10 may also be tipped completely onto the wheels 26 and legs 28 of the frame 14 to position the drain cleaning device 10 in a horizontal, operating position. The legs 28 are located adjacent a top side of the frame 14 and extend rearward from the frame 14.

As shown in FIG. 2, a handle assembly 34 is coupled to the frame 14 to facilitate transporting the drain cleaning device 10. The handle assembly 34 includes a handle housing 38 and a handle 42 that is slidable within the handle housing 38 between a retracted position (FIG. 2) and an extended position. An actuator 46 locks the handle 42 in the retracted position to inhibit the handle 42 from unnecessarily being extended out of the handle housing 38. In the illustrated embodiment, the actuator 46 is a button. A user may operate (e.g., depress) the actuator 46 to release the handle 42, allowing the handle 42 to be moved from the retracted position to the extended position. The actuator 46 may then also secure the handle 42 in the extended position. Once the handle 42 is in the extended position, a user may tilt the drain cleaning device 10 onto the wheels 26 and transport the drain cleaning device 10 to a new location. To return the handle 42 to the retracted position, the user may again operate the actuator 46 to release the handle 42, allowing the handle 42 to be moved from the extended position to the retracted position.

Figure 3:
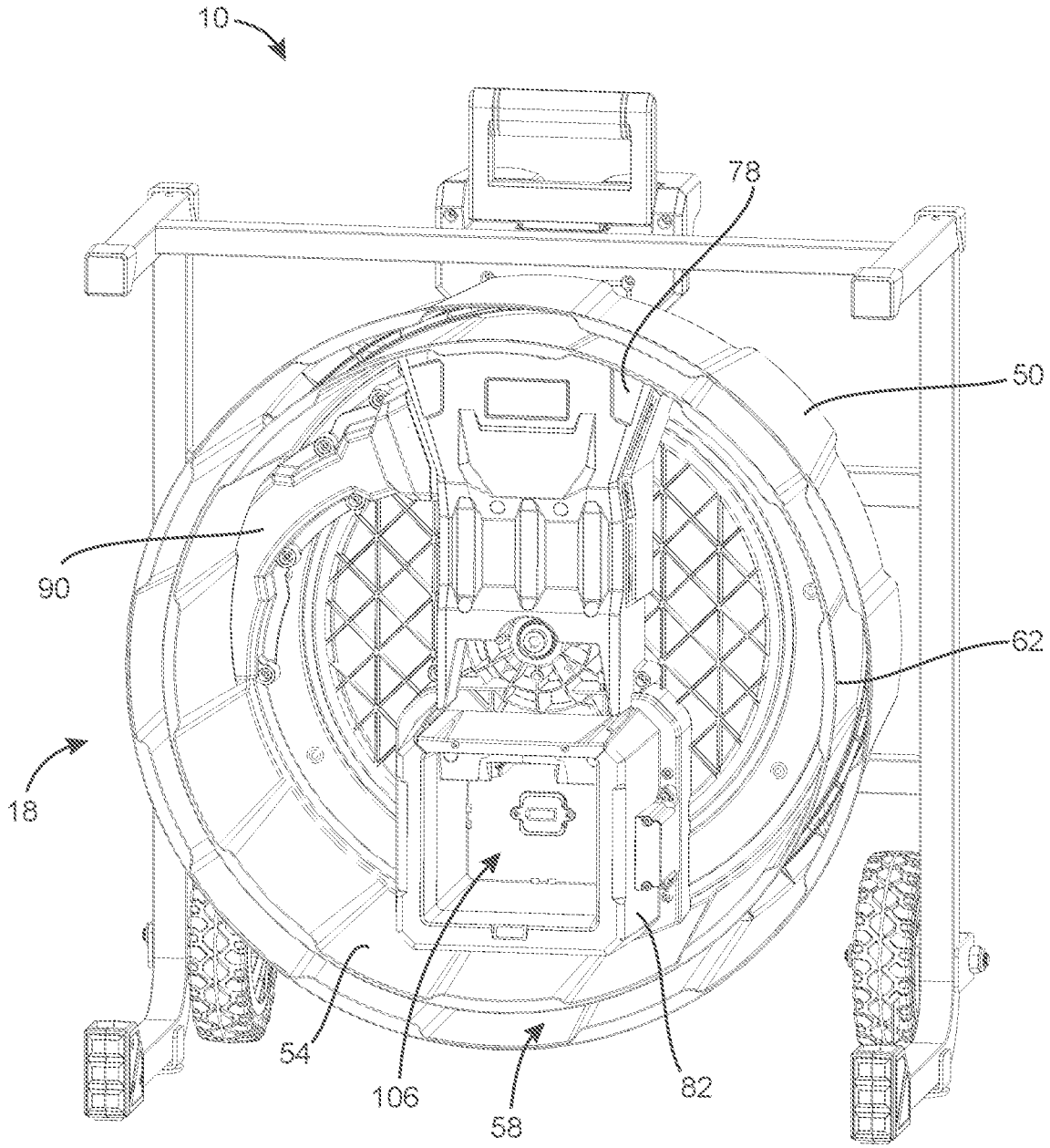
FIG. 3 is a front perspective view of the drain cleaning device of FIG. 1 with portions removed.

With reference to FIG. 3, the illustrated drum assembly 18 includes an outer drum 50) and an inner drum 54 coupled to the outer drum 50 for co-rotation therewith. In the illustrated embodiment, the outer and inner drums 50, 54 are cylindrical-shaped with an open front end and a closed rear end. In other embodiments, the inner and outer drums 50, 54 may be enclosed to define an interior. In further embodiments, the drum assembly 18 may further include a drum housing that surrounds the inner and outer drums 50, 54. The inner drum 54 has a smaller diameter than the outer drum 50 to define a space 58 therebetween. A drain cleaning cable 62 may be supported within the space 58, as described in more detail below. The drain cleaning cable 62 includes a first end 63 (FIG. 5) and a second end 64 opposite the first end 63 (FIG. 1).

Figure 4:
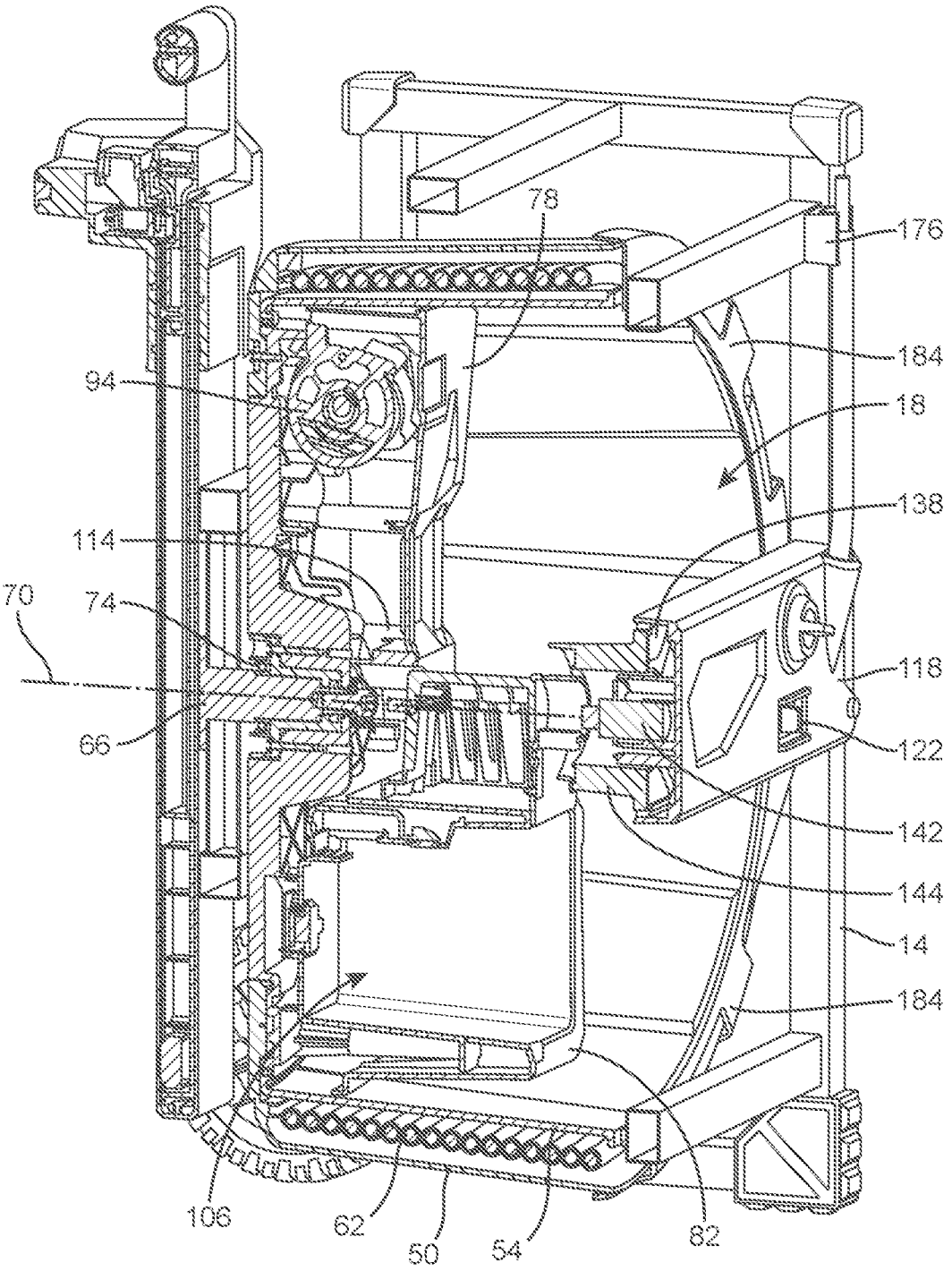
FIG. 4 is a cross-sectional view of the drain cleaning device of FIG. 1.

As shown in FIG. 4, the drum assembly 18 is supported on the frame 14 by a support shaft 66. The support shaft 66 includes a first end that is coupled to the frame 14 and a second end that is coupled to the inner drum 54. The support shaft 66 defines an axis of rotation 70 of the drum assembly 18. A bearing 74 is positioned between the inner drum 54 and the support shaft 66 to allow rotation of the inner drum 54 relative to the support shaft 66. In the illustrated embodiment, the drum assembly 18 is idly supported on the support shaft 66. In other words, the drum assembly 18 is allowed to freely rotate on the support shaft 66. In other embodiments, the drum assembly 18 may be driven by a motor to rotate with or about the support shaft 66.

Figure 5:
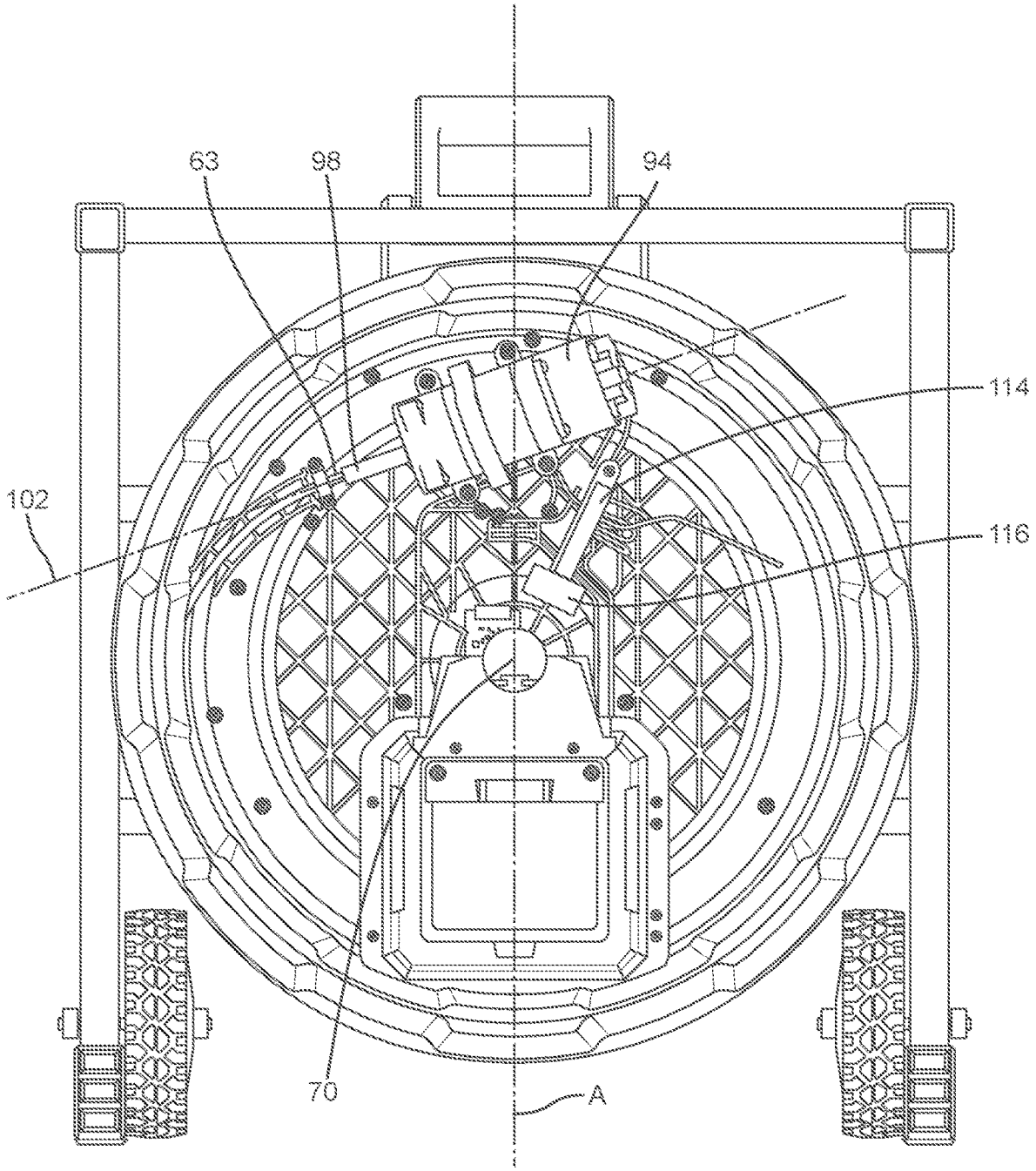
FIG. 5 is another front view of the drain cleaning device of FIG. 1 with portions removed.

Referring to FIGS. 3 and 4, the inner drum 54 supports a motor housing 78, a battery housing 82, and a guide housing 90. A motor 94 is supported within the motor housing 78. In some embodiments, the motor 94 may be a DC brushless motor. In other embodiments, the motor 94 may include a brush. As shown in FIG. 5, the motor 94 includes an output shaft 98 that defines a motor axis 102. The output shaft 98 is configured to be directly coupled to the first end 63 of the drain cleaning cable 62 to rotate the cable 62. The motor axis 102 is offset from the axis of rotation 70 of the drum assembly 18. More particularly, the motor axis 102 is spaced apart from, but perpendicular to the axis of rotation 70. The motor axis 102 is also orientated at an oblique angle relative to a vertical plane A (when the drain cleaning device 10 is in the upright position) extending through the axis of rotation 70. The vertical plane A extends through the support shaft 66 and the motor 94. The vertical plane A also extends through the battery housing 82. In other embodiments, the output shaft 98 may be oriented in other configurations and/or the motor 94 may be located elsewhere on the drain cleaning device 10.

Figure 8:
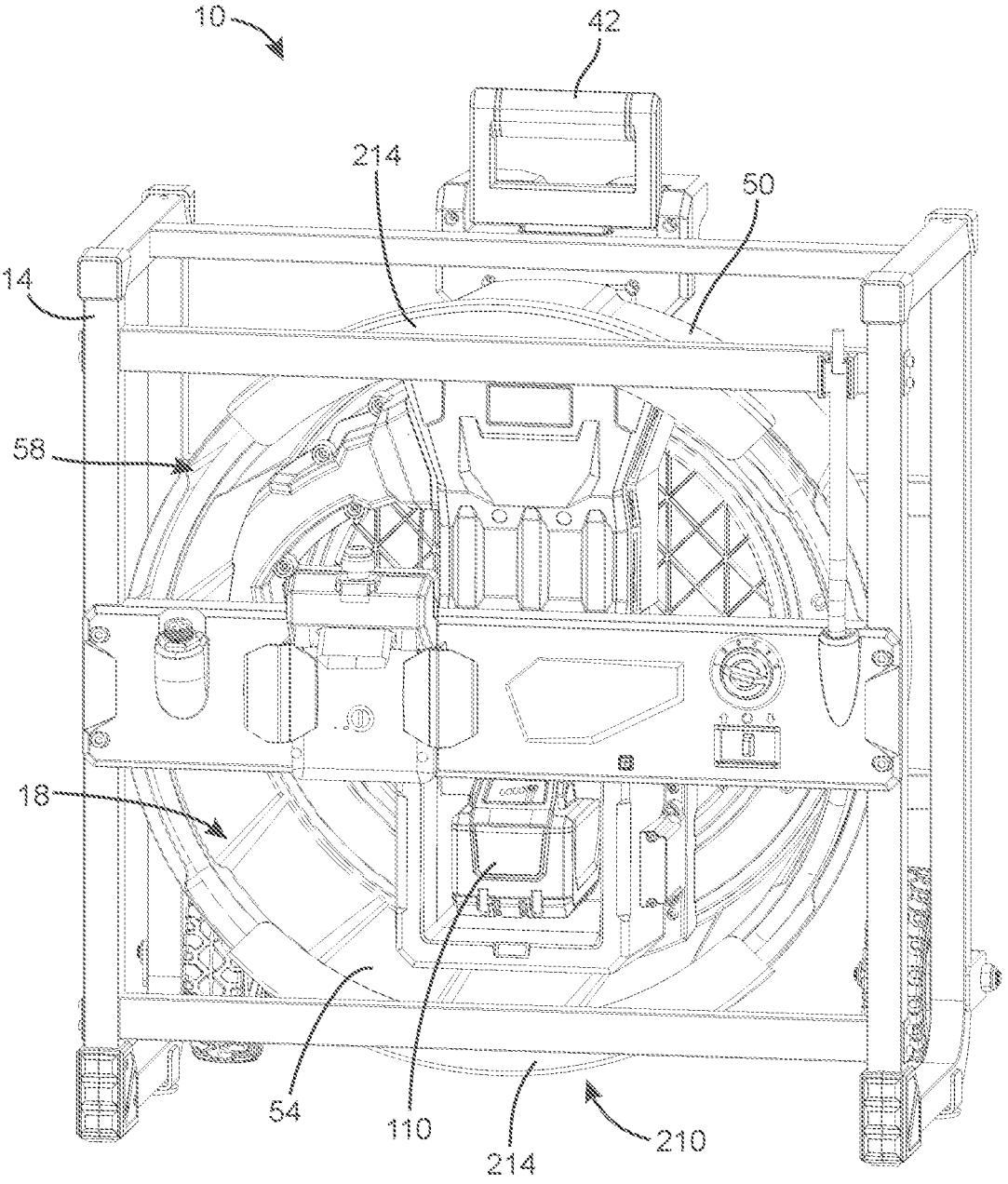
FIG. 8 is another front perspective view of the drain cleaning device of FIG. 1 with a cable stop assembly according to another embodiment.

With reference back to FIGS. 3 and 4, the battery housing 82 defines a battery receptacle 106 configured to receive a battery pack 110 (FIG. 8). In the illustrated embodiment, the battery receptacle 106 is positioned on a diametrically opposite side of the axis of rotation 70 form the motor 94. The battery pack 110 may include any of number of different nominal voltages (e.g., 12V, 18V, etc.), and may be configured having any of number of different chemistries (e.g., lithium-ion, nickel-cadmium, etc.). The battery pack 110 is operable to supply power to the motor 94 to energize the motor 94. The battery pack 110 is a removable battery pack. The battery pack 110 is also a rechargeable battery pack. Alternatively, the motor 94 may be powered by a remote power source (e.g., a household electrical outlet) through a power cord. In the illustrated embodiment, the battery pack 110 is inserted into the battery receptacle 106 in a direction that is parallel to the axis of rotation 70. As such, the battery pack 110 is mounted with its longitudinal axis parallel with the axis of rotation 70. In other embodiments, the battery pack 110 may be inserted into the battery receptacle 106 in a direction that is perpendicular or oblique to the axis of rotation 70. In further embodiments, the battery receptacle 106 may be positioned elsewhere on the drain cleaning device 10. For example, the battery receptacle 106 may be mounted on the frame 14. In such an embodiment, the battery pack 110 would not spin with the drum during a drain cleaning operation. Further, the battery receptacle 106 may be positioned adjacent the center of the inner drum 54. The battery housing 82 surrounds the battery pack 110 to inhibit fluids or other debris that may be expelled during operation of the drain cleaning device 10 from tampering with the battery pack 110.

Referring to FIGS. 4 and 5, control electronics 114 are disposed within the motor housing 78. In other embodiments, the control electronics 114 may be disposed within a separate housing from the motor housing 78. The control electronics 114 may include a controller or processor that controls operation of the drain cleaning device 10. In some embodiments, the controller is implemented as a microprocessor with separate memory. In other embodiments, the controller may be implemented as a microcontroller (with memory on the same chip). In other embodiments, the controller may be implemented using multiple processors. In addition, the controller may be implemented partially or entirely as, for example, a field-programmable gate array (FPGA), an application specific integrated circuit (ASIC), and the like, and the memory may not be needed or be modified accordingly. The memory may include non-transitory, computer readable memory that stores instructions that are received and executed by the controller to carry out functionality of the drain cleaning device 10 described herein. The memory may include, for example, a program storage area and a data storage area. The program storage area may include combinations of different types of memory, such as read-only memory and random-access memory. The control electronics 114 also include a dedicated fan 116 that specifically provides cooling to the control electronics 114. The fan 116 is coupled to a bracket that supports the control electronics 114.

With reference back to FIG. 1, a control panel 118 is supported on the frame 14. The illustrated control panel 118 is positioned in front of the drum assembly 18. The control panel 118 includes a user interface 122. The user interface 122 may include, for example, a control switch or other suitable actuators. The user interface 122 may be selectively actuated to control operation of the drain cleaning device 10. For example, a user may toggle the user interface 122 to change the rotation direction of the output shaft 98 when the motor 94 is energized. Additionally, the user interface 122 may be a master power switch to turn the drain cleaning device 10 on and off. In other embodiments, the user interface 122 may control other operations of the drain cleaning device 10.

The illustrated control panel 118 also includes clips 126 to support a foot pedal 130. Although not shown, a power cord may be coupled at one end to the foot pedal 130 and at another end to an outlet 134 on the control panel 118. The foot pedal 130 is removable from the control panel 118 to allow a user to remotely control the device cleaning device 10 (e.g., near an opening through which the cable 62 is inserted). In the illustrated embodiment, the foot pedal 130 may be depressed to activate the motor 94. In some embodiments, the foot pedal 130 may include a switch to change the rotation direction of the motor 94, and thereby the cable 62. In other embodiments, the foot pedal 130 may include a variable speed mechanism to control the speed the motor 94 rotates the cable 62. For example, the motor 94 may vary the rotation speed of the cable 62 based on how far the foot pedal 130 is depressed. In some embodiments, the control electronics 114 control the output speed of the motor 94 and thus the speed the cable 62 rotates (i.e., variable speed control). In such an embodiment, the control panel 118 may include a variable speed control actuator to adjust the output speed of the motor 94 and thus the cable 62. The variable speed control actuator may be a rotatable knob that may be set to a specific speed level (e.g., speed levels 1-10). In other embodiments, the variable speed control actuator may be positioned on the frame 14, the handle assembly 34, or another location on the drain cleaning device 10.

Referring to FIG. 4, in the illustrated embodiment, the control panel 118 defines an interior 138 that houses electrical components of the user interface 122 and the foot pedal 130. Specifically, the user interface 122 and the foot pedal 130 include electrical wires that are routed through the interior 138 of the control panel 118 to control electronics 114 in the motor housing 78. A slip ring 142 is positioned between the control panel 118 and the electronics housing 86 to inhibit the electrical cables that extend between the control panel 118 and the electronics housing 86 from tangling during rotation of the drum assembly 18. A shroud 144 surrounds the slip ring 142 to protect debris and contaminants from interfering with the electrical cables passing through the slip ring 142. The shroud 144 rotates with the drum assembly 18 during operation of the drain cleaning device 10 while the slip ring 142 remains stationary. The slip ring 142 also helps support the front side of the drum assembly 18. In some embodiments, the battery receptacle 106 may be supported on the control panel 118. In such an embodiment, power may be transferred from the battery pack 110 to the motor 94 via electrical wires that pass through the slip ring 142. In further embodiments, the slip ring 142 may be positioned adjacent the support shaft 66 to allow electrical wires to pass through the back of the drum assembly 18 to the motor 94 or control electronics 114.

Figure 6:
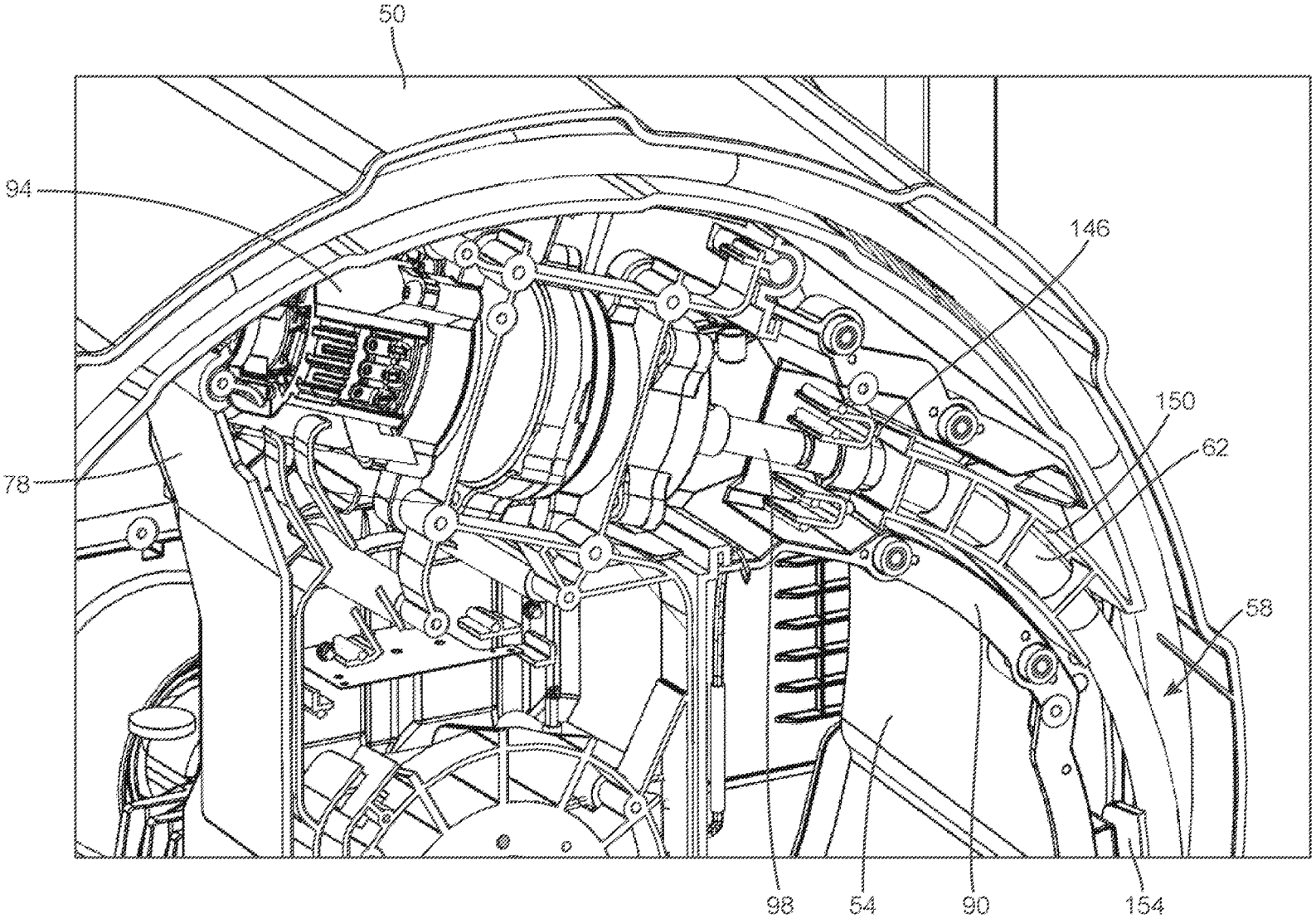
FIG. 6 is a rear perspective view of part of the drain cleaning device of FIG. 1 with portions removed.

With reference to FIG. 6, the guide housing 90 is coupled to the inner drum 54 adjacent the motor housing 78. The guide housing 90 defines a cavity 146 and a guide channel 150 extending from the cavity 146. The output shaft 98 of the motor 94 extends from the motor housing 78 into the cavity 146 in a direction that is aligned with the guide channel 150. The guide channel 150 terminates adjacent an opening 154 in the inner drum 54 that extends into the space 58 defined between the inner and outer drums 50, 54.

In the illustrated embodiment, the drain cleaning cable 62 is also known as a flexible shaft cable. The flexible shaft cable 62 includes a wound cable 158 that is encased by a sheath 162 (FIG. 1). The wound cable 158 is operable to be rotated by the motor 94 within the sheath 162. The flexible shaft cable 62 includes the first end 63 that is coupled to the motor 94 and the second end 64 that is operable to be extended into a drain to facilitate clearing the drain. Specifically, the wound cable 158 is coupled to the output shaft 98 of the motor 94 at the first end 63 of the cable 62 to rotate the wound cable 158 within the sheath 162. The wound cable 158 may be directly coupled to the output shaft 98 or may be coupled to the output shaft 98 through a drive mechanism (e.g., a gear reduction mechanism or the like). The portion of the cable 62 between the first and second ends 63, 64 extends from the output shaft 98 through the guide channel 150 and the opening 154 in the inner drum 54 to be coiled within the space 58 between the inner and outer drums 50, 54. The second end 64 of the cable 62 extends from the space 58 and through an outlet tube 174 (FIG. 1) disposed on the control panel 118. The outlet tube 174 assists a user in directing the cable 62 into a conduit. The second end 64 of the cable 62 may be supported by a receptacle 176 (FIG. 1) positioned on the frame 14 of the drain cleaning device 10 when the drain cleaning device 10 is not in use. In some embodiments, a cable accessory may be coupled to the second end 64 of the cable 62. In some embodiments, the stiffness of the cable 62 depends on the size of the drum assembly 18. For example, for an outer drum 50 with a larger diameter, a cable having a higher stiffness will have less energy loss during operation of the drain cleaning device 10. As such, a ratio of the cable stiffness, in Newtons per millimeter (N/mm), to diameter of the drum, in inches (in.), is between 0.25 and 1.0. In some embodiments, the ratio of the cable stiffness to diameter of the drum is between 0.5 and 0.75. In further embodiments, the ratio of the cable stiffness to diameter of the drum may be more than 1.0 or less than 0.25.

Figure 7:
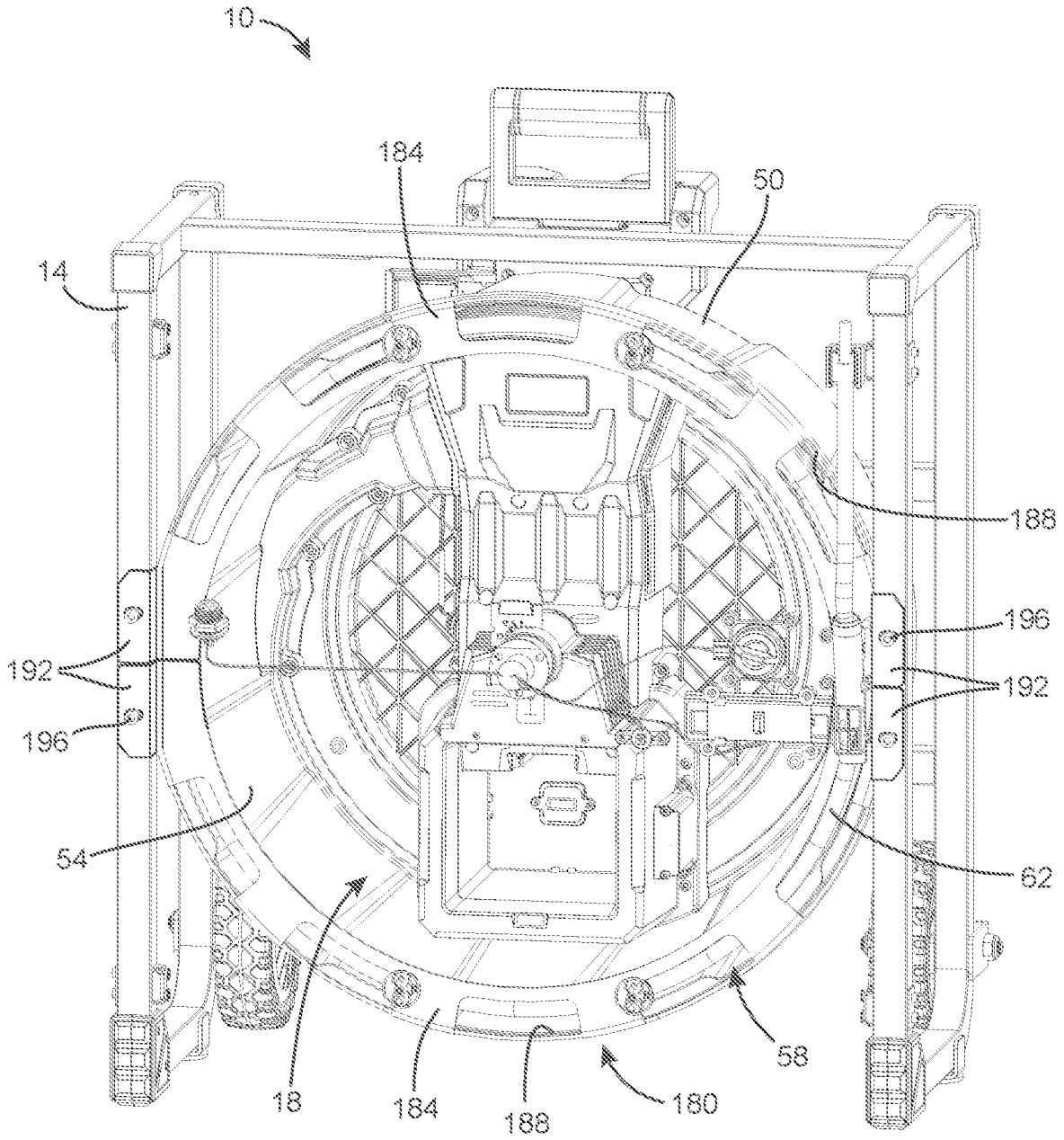
FIG. 7 is another front view of the drain cleaning device of FIG. 1 with portions removed.

With reference to FIG. 7, the drain cleaning device 10 also includes a cable stop assembly 180. The cable stop assembly 180 is disposed adjacent the open end of the drum assembly 18 between the inner and outer drums 50, 54 to at least partially cover the space 58 therebetween. The cable stop assembly 180 is also positioned between the space 58 and the control panel 118 and frame 14. The illustrated cable stop assembly 180 includes two half-circle shaped bumpers 184 that substantially cover the space 58 and the cable 62. In other words, the bumpers 184 continuously extend around the perimeter of the space 58. Each bumper 184 includes a plurality of openings 188 and support brackets 192 positioned at the distal ends. The outer sides of each bumper 184 also extend slightly over the outside of the outer drum 50. The inner sides of each bumper 184 generally match the size of the inner drum 54 such that the bumpers 184 do not extend over or cover the space inside of the inner drum 54. The openings 188 allow the cable 62 to extend out of the space 58 and into the outlet tube 174 of the control panel 118. The openings 188 also facilitate drying the cable 62 after use. The support brackets 192 are positioned between the frame 14 and the control panel 118. Fasteners 196 (e.g., bolts, rivets, etc.) are used to couple the bumpers 184 to the frame 14. In the illustrated embodiment, the fasteners 196 also couple the control panel 118 to the frame 14. In other embodiments, the bumpers 184 may be coupled to the frame 14 with separate fasteners than the ones used to couple the control panel 118 to the frame 14. For example, one bumper 184 may be coupled to a top link **200*a* of the frame 14 and one bumper 184 may be coupled to a bottom link 200*b* of the frame 14 (FIG. 1). In further embodiments, the bumpers 184 may be coupled to the drum assembly 18 using a press fit to cover the open end of the drum assembly. In another embodiment, the bumpers 184 may be coupled to the drum assembly 18 for rotation therewith. Although the illustrated cable stop assembly 180 includes two bumpers 184, in other embodiments, the cable stop assembly 180 may include fewer or more bumpers 184. For example, the cable stop assembly 180 may only include one bumper that extends around an entire circumference of the drum assembly 18 or may include three or more bumpers. The bumpers 184** may also have similar sizes or may be differently sized.

When the cable stop assembly 180 is positioned for use, the bumpers 184 cover a circumferential portion of the space 58 to inhibit the cable 62 from unintentionally escaping the space 58 during a drain cleaning operation or while transporting the drain cleaning device 10. As the drum assembly 18 rotates about the axis of rotation 70 during operation, the bumpers 184 remain stationary and fixed to the frame 14. In other embodiments, the bumpers 184 may be fixed to the drum assembly 18 to rotate with the drum assembly 18.

FIG. 8 illustrates another cable stop assembly 210 for use with the drain cleaning device 10. The cable stop assembly 210 is similar to the cable stop assembly 180 discussed above with like features being represented with like reference numbers. The cable stop assembly 210 includes two bumpers 214 on diametrically opposite sides of the axis of rotation 70. One of the bumpers 214 is coupled to the top link 200*a* (FIG. 1) of the frame 14, and the other bumper 214 is coupled to the bottom link 200*b* (FIG. 1) of the frame 14. The bumpers 214 only partially cover the space 58 between the inner and outer drums 50, 54. In other words, the bumpers 214 are each half-moon shaped and discontinuously extend around the perimeter of the space 58. In the illustrated embodiment, the bumpers 214 do not include openings. The cable 62 may instead extend out of the space 58 through a gap between ends of the bumpers 214.

In other embodiments, the top and bottom links 200*a*, 200*b* of the frame 14 may include an increased width (or thickness) such that an inner side of the links 200*a*, 200*b* is positioned closer to the space 58 of the drum assembly 18. The increased width would reduce a gap between the frame 14 and the drum assembly 18 to inhibit the cable 62 from escaping the space 58 during operation. In other embodiments, the size (e.g., width, thickness, etc.) of the links 200*a*, 200*b* may be increased to inhibit the cable 62 from escaping the space 58 during operation. In such embodiments, the links 200*a*, 200*b* may act as a cable stop assembly.

In the illustrated embodiment, the output shaft 98 of the motor 94 directly drives the wound cable 158 to rotate within the sheath 162. In other embodiments, the drain cleaning device 10 may include a transmission to transfer rotation from the output shaft 98 to the cable 62. The transmission may include a gear system to transfer torque from the motor 94 to the cable 62. For example, the transmission may include a planetary gear system including a single stage or multiple stages, a planetary gearset with a bevel gear set, a planetary gearset with two bevel gearsets, only two bevel gearsets, a spur gearset, a helical gearset, a multi-speed gearbox, or a continuously variable gearbox.

In some embodiments, the drain cleaning device 10 includes a clutch disposed between the output shaft 98 of the motor 94 and the first end 63 of the cable 62. The clutch is operable to allow slip between the output shaft 98 and the cable 62 if the output torque of the motor 94 exceeds a predetermined limit to protect the cable 62. In other embodiments, the clutch may be an electronic clutch that senses the output torque of the motor 94 by, for example, sensing the current supplied to the motor 94 from the battery pack 110. The electronic clutch may then allow slip to occur if the electronic clutch senses that the output torque from the motor 94 was above a predetermined limit. Alternatively, the electronic clutch may sense when the current is above the predetermined limit and communicate with the control electronics 114 to depower the drain cleaning device 10.

During operation of the drain cleaning device 10, a user may extend the second end 64 of the cable 62 into a drain or other conduit. As the cable 62 is payed out from the drum assembly 18, the drum assembly 18 rotates in a first direction. Once the second end 64 of the cable 62 encounters a clog, the user may depress the foot pedal 130 to activate the motor 94 and rotate the wound cable 158 within the sheath 162. Based on the user interface 122, the wound cable 158 will spin either clockwise or counterclockwise within the sheath 162. As the wound cable 158 rotates, the cable accessory assists in removing the debris or clog. Alternatively, a user may force the second end 63 of the cable 62 past the debris within a drain first before activating the motor 94. Then, the user may depress the foot pedal 130 to activate the motor 94 while retracting the cable 62 out of the drain. The motor 94 rotates the wound cable 158 and thus the cable accessory to remove the debris or clog. While the cable 62 is being retracted from the drain, the drum assembly 18 rotates in a second direction, opposite the first direction, to wind the cable 62 back within the space 58. In some embodiments, the drain cleaning device 10 may include a sensor that detects when the cable 62 is being retracted from a drain. The sensor then communicates with the control electronics 114 to automatically activate the motor 94 to rotate the wound cable 158. For example, the sensor may detect that the drum assembly 18 is spinning in the second direction and activate the motor 94. Alternatively, the sensor may be positioned on the cable 62 to detect rearward movement of the cable 62. Once the drain has been sufficiently removed of debris and clogs, the user can then retract the cable 62 from the drain to store the cable 62 within the drum assembly 18.

In some embodiments, the control electronics 114 may include a wireless communication device to communicate with an external device, such as a smart phone or tablet. The wireless communication device communicates with the control electronics 114 based on user input from the external device. For example, a user may use the external device to define operating parameters of the drain cleaning device 10 such as minimum and maximum torque or revolutions per minutes of the output shaft 98 of the motor 94.

Providing a drain cleaning device 10 with a motor 94 that directly drives a cable 62 allows the cable 62 to rotate at higher torque compared to drain cleaning devices that rely on driving a drum assembly to produce friction to rotate the cable. Rotating the cable 62 at higher torque more efficiently cleans a drain or other conduit.

Various features of the disclosure are set forth in the following claims.

What is claimed is:

1. A drain cleaning device comprising:

a frame;

a drum assembly supported by the frame, the drum assembly including an inner drum, an outer drum, and a space defined therebetween, the drum assembly configured to rotate about an axis of rotation;

a motor supported by the drum assembly, the motor including an output shaft;

a flexible cable stored within the space, the flexible cable defining a first end and a second end opposite the first end, the first end coupled to the output shaft to receive torque from the motor; and a cable stop assembly positioned over at least a portion of the space to at least partially cover the space.

2. The drain cleaning device of claim 1, wherein the cable stop assembly extends continuously around an entire perimeter of the space.

3. The drain cleaning device of claim 1, wherein the cable stop assembly extends discontinuously around an entire perimeter of the space.

4. The drain cleaning device of claim 1, wherein the cable stop assembly includes a first cable stop and a second cable stop positioned on a diametrically opposite side of the drum assembly from the first cable stop.

5. The drain cleaning device of claim 4, wherein the first cable stop and the second cable stop are half-moon shaped.

6. The drain cleaning device of claim 1, wherein the cable stop assembly includes a bumper positioned between the frame and the drum assembly.

7. The drain cleaning device of claim 1, wherein the cable stop assembly includes a bumper with an opening into the space.

8. The drain cleaning device of claim 1, wherein the flexible cable includes a wound cable and a sheath disposed around the wound cable, and wherein the wound cable is rotatable relative to the sheath.

9. The drain cleaning device of claim 1, wherein the drum assembly includes a closed rear end and open front end opposite the rear end.

10. The drain cleaning device of claim 9, wherein the cable stop assembly is disposed adjacent the open front end of the drum assembly.

11. The drain cleaning device of claim 1, wherein the drum assembly is idly supported by the frame.

12. The drain cleaning device of claim 1, wherein the frame includes a plurality of links coupled together to form a cage-like structure.

13. The drain cleaning device of claim 12, wherein at least one of the plurality of links extends across a portion of the drum assembly and forms the cable stop assembly.

14. The drain cleaning device of claim 1, wherein the cable stop assembly is coupled to the frame.

15. The drain cleaning device of claim 14, wherein the cable stop assembly remains stationary while the drum assembly rotates.

16. The drain cleaning device of claim 1, further comprising a battery receptacle supported by the drum assembly and configured to receive a battery pack to supply power to the motor.

* * * * *